US005398730A

United States Patent [19]

Derudder et al.

[11] Patent Number: 5,398,730

[45] Date of Patent: Mar. 21, 1995

[54] FACE-TO-FACE 2-SHOT CARPET WEAVE

[75] Inventors: Carlos Derudder, Kortrijk/Heule; Nico Gheysen, Sint Eloois-Winkel, both of Belgium

[73] Assignee: N.V. Michel Van de Wiele, Kortrijk/Marke, Belgium

[21] Appl. No.: 931,662

[22] Filed: Aug. 19, 1992

Related U.S. Application Data

[63] Continuation of Ser. No. 709,819, Jun. 4, 1991, abandoned.

[30] Foreign Application Priority Data

Jun. 5, 1990 [BE] Belgium ..... 0900563

[51] Int. Cl.[6] ..... D03D 27/10

[52] U.S. Cl. ..... 139/21; 139/398

[58] Field of Search ..... 139/398, 21

[56] References Cited

U.S. PATENT DOCUMENTS 3,327,738 6/1967 Sabbe ..... 139/398

3,519,032 7/1970 Sabbe .

FOREIGN PATENT DOCUMENTS 0119184 9/1984 European Pat. Off. .

1535796 7/1970 Germany .

0256239 5/1988 Germany ..... 139/398

OTHER PUBLICATIONS

Zucker, "Comparison of Carpet Weaves", Melliand Textilberichte, vol. 65, No. 1, pp. 31–34 (Germany 1984).

*Primary Examiner*—Andrew M. Falik

*Attorney, Agent, or Firm*—James Creighton Wray

[57] ABSTRACT

In weaving face-to-face pile fabrics, in a 2-shot weave, pattern forming portions of pile warps go over 3 wefts while bound-in portions go over only 2 picks. Working pattern repeats—over 3 wefts—are defined for each possible pile warp by aprons which determine the positions of the pile warps. Resultant pile fabrics have precise pattern definition with no crossed piles at pattern borders.

12 Claims, 7 Drawing Sheets

PRIOR ART

| CARD DRAWING | PRESENT PF IS: | PREVIOUS PATTERN REPEAT WAS: | PF IN PREVIOUS PATTERN REPEAT | TYPE OF PILE THREAD IN PREVIOUS PATTERN REPEAT | BASE PATTERN REPEAT A OR B | LIFT PLAN NUMBER |
|---|---|---|---|---|---|---|
| PF | PFBW | L | | | A | 1 |
| | | | | | B | 2 |
| | | PF | SAME PILE THREAD | | A | 3 |
| | | | | | B | 4 |
| | | | DIFFERENT PILE THREAD | PFBW | A | 5 OR 5' |
| | | | | | B | 6 OR 6' |
| | | | | PFTW | A | 7 |
| | | | | | B | 8 |
| | PFTW | L | | | A | 9 |
| | | | | | B | 10 |
| | | PF | SAME PILE THREAD | | A | 11 |
| | | | | | B | 12 |
| | | | DIFFERENT PILE THREAD | PFBW | A | 13 |
| | | | | | B | 14 |
| | | | | PFTW | A | 15 OR 15' |
| | | | | | B | 16 OR 16' |
| L | | | | | A | 17 |
| | | | | | B | 18 |

FIG. 3

| LIFT PLAN NUMBER | SHOT NO. | WORKING FIGURE-FORMING PILE (1) | WORKING PREVIOUS FIGURE-FORMING PILE (2) | WORKING PBBW (3) IF NOT (1) OR (2) | WORKING PBTW (4) IF NOT (1) OR (2) |
|---|---|---|---|---|---|
| 1 | 1<br>2<br>3 | B<br>T<br>B | | M<br>B<br>M | T<br>M<br>T |
| 2 | 1<br>2<br>3 | T<br>B<br>T | | B<br>M<br>B | M<br>T<br>M |
| 3 | 1<br>2<br>3 | B<br>T<br>B | | M<br>B<br>M | T<br>M<br>T |
| 4 | 1<br>2<br>3 | T<br>B<br>T | | B<br>M<br>B | M<br>T<br>M |
| 5 | 1<br>2<br>3 | B<br>T<br>B | M<br>B<br>M | M<br>B<br>M | T<br>M<br>T |

FIG. 4a-1

| LIFT PLAN NUMBER | SHOT NO. | WORKING FIGURE-FORMING PILE (1) | WORKING PREVIOUS FIGURE-FORMING PILE (2) | WORKING PBBW (3) IF NOT (1) OR (2) | WORKING PBTW (4) IF NOT (1) OR (2) |
|---|---|---|---|---|---|
| 6 | 1 | B | T | B | M |
| | 2 | B | M | M | T |
| | 3 | T | B | B | M |
| 7 | 1 | B | T | M | T |
| | 2 | T | M | B | M |
| | 3 | B | T | M | T |
| 8 | 1 | B | T | B | M |
| | 2 | B | T | M | T |
| | 3 | T | M | B | M |
| 9 | 1 | B | | M | T |
| | 2 | T | | B | M |
| | 3 | B | | M | T |
| 10 | 1 | T | | B | M |
| | 2 | B | | M | T |
| | 3 | T | | B | M |

FIG. 4a-2

| LIFT PLAN NUMBER | SHOT NO. | WORKING FIGURE-FORMING PILE (1) | WORKING PREVIOUS FIGURE-FORMING PILE (2) | WORKING PBBW (3) IF NOT (1) OR (2) | WORKING PBTW (4) IF NOT (1) OR (2) |
|---|---|---|---|---|---|
| 11 | 1 | B | | M | T |
| | 2 | T | | B | M |
| | 3 | B | | M | T |
| 12 | 1 | T | | B | M |
| | 2 | B | | M | T |
| | 3 | T | | B | M |
| 13 | 1 | T | B | M | T |
| | 2 | T | B | B | M |
| | 3 | B | M | M | T |
| 14 | 1 | T | B | B | M |
| | 2 | B | M | M | T |
| | 3 | T | B | B | M |
| 15 | 1 | T | B | M | T |
| | 2 | T | M | B | M |
| | 3 | B | T | M | T |

FIG. 4a-3

| LIFT PLAN NUMBER | SHOT NO. | WORKING FIGURE-FORMING PILE (1) | WORKING PREVIOUS FIGURE-FORMING PILE (2) | WORKING PBBW (3) IF NOT (1) OR (2) | WORKING PBTW (4) IF NOT (1) OR (2) |
|---|---|---|---|---|---|
| 16 | 1<br>2<br>3 | T<br>B<br>T | M<br>T<br>M | B<br>M<br>B | M<br>T<br>M |
| 17 | 1<br>2<br>3 | | | M<br>B<br>M | T<br>M<br>T |
| 18 | 1<br>2<br>3 | | | B<br>M<br>B | M<br>T<br>M |

FIG. 4a-4

| LIFT PLAN NUMBER | SHOT NO. | WORKING FIGURE-FORMING PILE (1) | WORKING PREVIOUS FIGURE-FORMING PILE (2) | WORKING PBBW (3) IF NOT (1) OR (2) | WORKING PBTW (4) IF NOT (1) OR (2) |
|---|---|---|---|---|---|
| 5' | 1 | B | B | M | T |
| | 2 | T | B | B | M |
| | 3 | B | M | M | T |
| 6' | 1 | B | T | B | M |
| | 2 | B | B | M | T |
| | 3 | T | B | B | M |
| 15' | 1 | T | B | M | T |
| | 2 | T | T | B | M |
| | 3 | B | T | M | T |
| 16' | 1 | T | T | B | M |
| | 2 | B | T | M | T |
| | 3 | T | M | B | M |

FIG. 4b

FACE-TO-FACE 2-SHOT CARPET WEAVE

This application is a continuation of application Ser. No. 709,819, filed Jun. 4, 1991, now abandoned.

SUMMARY OF THE INVENTION

The invention relates to a method for the production of face-to-face woven carpets, in which the figures are formed by the so-called pile warp threads, which run from the top weave to the bottom weave and vice versa, and which are divided into working or figure-forming pile, at the moment that the pile threads of one weave run to the other, while the non-working pile threads are called the dead pile.

More particularly, the invention relates to a method for weaving a face-to-face weave in 2-shot weave on a face-to-face gripper weaving machine.

The state of the art is illustrated with reference to the appended FIG. 1, which shows schematically a double-spool 2-shot weave of a face-to-face weave. For the weaving of a face-to-face carpet weave according to the double-spool weaving principle, a weft thread (W) is inserted simultaneously into the bottom weave (BW) and into the top weave (TW). On one shot the weft (W) of the bottom weave (BW) is situated below the tension warp thread (TB) of the bottom weave (BW) and the weft (W) of the top weave (TW) is below the tension warp thread (TT) of the top weave (TW). On the next shot the weft (W) of the BW is above the tension warp thread (TB) and the weft (W) of the top weave (TW) is above the tension warp thread TT.

In order to bind the weft (W) to the tension warps TB and TT, one or more binding warps BB and BT are added.

There are various known ways of binding off these binding warps. There is what is called a 2-shot weave—as is the case in the example in FIG. 1—when the weave on shot 1–2 is repeated on shot 3–4, on shot 5–6 etc.

For the numbering of each shot, one starts off from the weft furthest to the left—comprising two weft threads (W) inserted above one another, in TW and BW respectively—which is called shot 1, while following the weave from left to right in FIG. 1, the successive double weft insertions in sequence are described as shot 2, shot 3 etc . . . This numbering is indicated vertically below each weft on the figure. The pile warp threads are indicated as P1, P2, P3, P4, P5.

As regards the grippers or as regards each weft insertion, these pile warp threads can theoretically take up three positions: bottom—middle (between)—top.

If the pile warp thread does not make any connection between the bottom weave (BW) and the top weave (TW), i.e. if dead pile occurs, this pile warp thread takes part in the binding of BW or TW, and we speak of a bound-in pile warp thread, or simply a bound-in dead pile.

A bound-in pile warp thread—for example P1—has in the next shot 1 the choice either to remain bound in, or as a working or figure-forming pile warp thread to connect the weaves, e.g. BW and TW to the other TW and BW respectively. In the case of the next shot 2 one again has the same choice for the same pile warp thread, namely using for binding in or again working as a figure-forming pile warp thread. If a. pile warp thread—for example, P3—acts as a working thread in shot 1, this thread P3, which before shot 1 was bound into one bare weave, e.g. bottom weave (BW), is first bound off under shot 1, and on shot 2 is bound off in the other base weave, namely top weave (TW), by running above the weft (W) of the top weave and then returning to the bottom weave.

Thus, in practical terms, two positions per shot are sufficient to weave a 2-shot weave—in order to bind into the top weave: top and middle; into the bottom weave: bottom and middle; and in order to weave pile: bottom and top. By combining these positions in succession with a Jacquard machine, the 2-shot weave is thus obtained.

This 2-shot weave has the disadvantage that it has so-called mix contours, At the transition from a particular color, formed by a figure-forming pile warp thread which after that transition is bound into the top weave, to another color, formed by a figure-forming pile warp thread which was bound into the bottom weave before that transition, a side of the last pile loop of the stopping color runs over into the new color, and a side of the first pile loop of the new color already begins in the previous color (see shots 3 to 6 in FIG. 1).

The dividing line between these two color fields is consequently disturbed through the fact that the expected color of a first pile runs out into the color of the last pile, and the color of the last pile already begins in the color field of the first pile. This takes place at the transition in two successive pattern repeats, e.g. if a weave pattern (shot 3–4) with a figure-forming pile thread (P3) which is bound into the bottom weave (BW) is followed by a weave pattern repeat (shot 5–6) with another figure-forming pile thread (P2), which is bound into the top weave (TW).

In order to avoid these mix contours, the color fields can be kept separate from each other by an additional insertion of a pattern repeat line wad in which over 2 shots no figure-forming pile thread is used.

In order to achieve this, this effect will already be drawn in during the design of the card drawing, in order to achieve a perfect color transition. This, of course, creates an enormous amount of additional work for the card designer. A second possibility is that in which the card drawing is made for 1 color point every 4 shots in the carpet. The result of this is that the fineness of the drawing is halved, and a low density will thus be obtained in the carpet.

For a design fineness of e.g. 4 picks/cm, 16 shots per cm have to be placed. This method is not acceptable.

SUMMARY OF THE INVENTION

The subject of the invention is a method for weaving a face-to-face pile weave, more particularly of a 2-shot weave according to the double-spool weaving process, with the object of avoiding mix contours, without the design fineness thereby being reduced, and while retaining the same speed of weaving.

The method according to the invention is characterised in that the imposed working pattern repeat for the pile warp threads goes over 3 shots, while the working pattern repeat of the base weave only goes over 2 shots.

Further details and advantages of the method according to the invention will emerge from the description which follows of a method according to the invention with reference to the appended figures and tables.

BRIEF DESCRIPTION OF THE DRAWINGS

FIG. 3 is the view of a decision diagram for the selection of an lift plan.

FIGS. 4*a* and 4*b* are tables on the correspondence between the aprons used and the desired positions of the pile warp threads.

DETAILED DESCRIPTION OF THE DRAWINGS

Figure 2A:
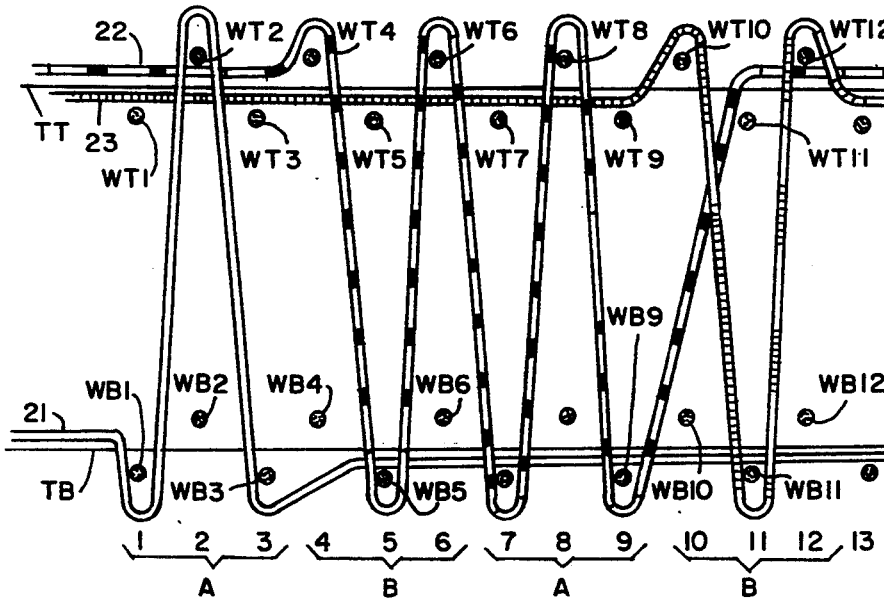
FIG. 2*a* is a schematic view of a face-to-face double-spool 2-shot weave according to the invention, in which double points along the pile side of the weave are preferred.
Figure 2B:
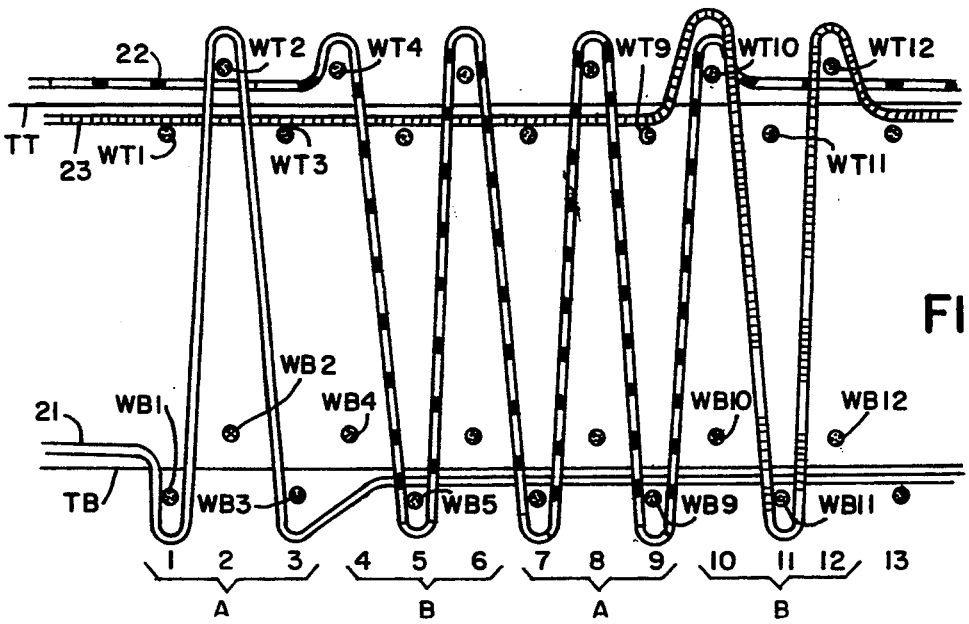
FIG. 2*b* is a schematic view of a face-to-face double-spool 2-shot weave according to the invention, in which double points along the rear side of the weave are preferred.

In the case of a face-to-face pile weave according to a double-spool woven 2-shot weave, the weaves of which are shown in FIGS. 2*a* and 2*b*, a weft is inserted into the bottom weave (BW) and the top weave (TW) simultaneously.

For each odd shot (1, 3, 5 . . . ) the weft (WB1, WB3 . . . ) of the bottom weave (BW) is situated below the tension warp (TB), and the weft (WT1, WT3 . . . ) of the top weave below the tension warp (TT).

For each even shot (2, 4, 6 . . . ) the weft (WB2, WB4 . . . ) of the bottom weave (BW) is situated above the tension warp (TB), and the weft (WT2, WT4 . . . ) of the top weave above the tension warp (TT).

Figure 1:
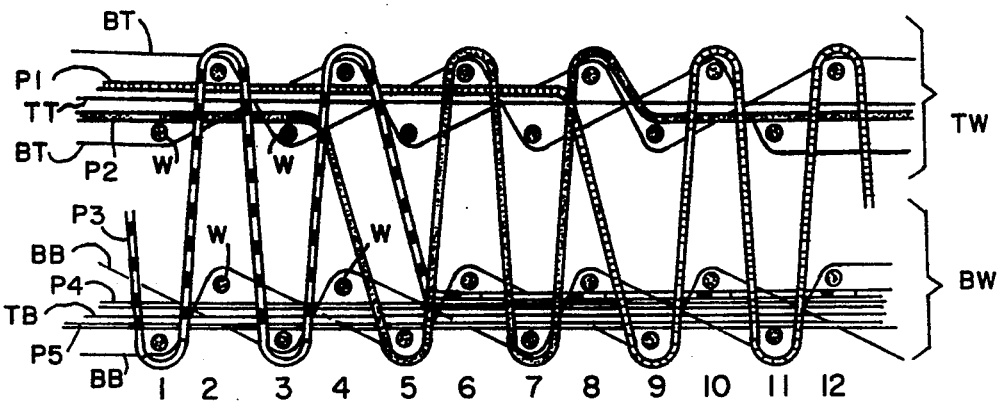
FIG. 1 is a schematic view of a face-to-face double-spool 2-shot weave according to the state of the art.

The way in which these wefts are bound off by means of binding warps BB and BT is known and takes place under a 2-shot pattern repeat (hence the name "2-shot weave") as shown in FIG. 1.

On the other hand, in the method according to the invention a working pattern repeat for the pile warp threads is imposed over three shots: this working pattern repeat is spedified for the figure-forming (PF) pile warp threads, for the pile warp threads bound into the top weave (PBTW) and bound into the bottom weave (PBBW).

In the case of a triple warp weave, such as shown in FIG. 2*a*, pile warp thread (21) in the case of shot (1, 2, 3) is figure-forming, and bound into the bottom weave on shot (4, 5, 6), (7, 8, 9), . . . ; pile warp thread (22) is bound into the top weave on shot (1, 2, 3) and is figure-forming on shot (4, 5, 6), (7, 8, 9), and is bound back into top weave on shot (10, 11, 12); pile warp thread (23) is bound into top weave on shot (1, 2, 3) (4, 5, 6) (7, 8, 9) and is figure-forming on shot (10, 11, 12). On the card one obtains 1 color point for every 3 shots in the carpet, while the working pattern repeat for the pile warp threads over three shots goes with alternately a pattern repeat A and B for binding off in the base weave For pattern repeat A we have:

WB1 below TB and WT1 below TT

WB2 above TB and WT2 above TT

WB3 below TB and WT3 below TT

For pattern repeat B we have:

WB4 above TB and WT4 above TT

WB5 below TB and WT5 below TT

WB6 above TB and WT6 above TT

The position to be taken up by the pile warp threads in a specific working pattern repeat depends on the position of the pile warp threads during the previous pattern repeat, either in a figure-forming pile or bound in, or in the working pattern repeat A, or in the working pattern repeat B.

The various possibilities are collected in FIG. 3. This table can be used for the selection of the correct lift plan. The expressions "Lift Plans" and "Aprons" are used interchangeably to described means for positioning warps in weaving. Lift plans themselves are not a feature of the invention, since they are well known in the art of weaving. The particular use of lift plans for determining particular positions of warps according to the method of the invention is essential to the invention. The following abbreviations are used:

PF: figure-forming pile warp thread

L: (bound-in Pile warp thread)

BW: bottom weave

TW: top weave

According to the desired method, FIG. 4*a* shows the weave lift plans to be used, together with the respective positions-for the warp threads.

For every 2 shots of the base weave one pile loop with at least one side is formed on the bottom weave (BW), and on the top weave (TW). Only a pile is missing (see shot 3, 4 in FIG. 2*a*) of a figure-forming pile thread in the bottom weave, in the transition from working pattern repeat A to B when a new figure-forming pile warp thread comes out of the top weave in a working pattern repeat B downwards and the previous color (the previous figure-forming pile warp thread) has to be bound into this working pattern repeat B.

In the weave according to the method according to the invention as shown in FIG. 2*a*, we have:

On shot 1, 2, 3 a figure-forming pile warp thread (21) which is provided for binding into the bottom weave (BW), while the previous working pattern repeat A was not a figure-forming one, and now the working pattern repeat A, and thus lift plan (1) must be used (see Table of FIG. 3).

On shot 4, 5, 6 pile warp thread 22 is the figure-forming pile warp thread pile warp thread 23 is provided for binding into the top weave. The previous pattern repeat was pile-forming, but from a different pile warp thread 21 which was provided for being bound into the bottom weave, and it is the turn of working pattern repeat B. Lift plan (14) then has to be used (see FIG. 3). There is no mixed contour between (1, 2, 3) and (4, 5, 6) in the transition from working pattern repeat A to B (see FIG. 2*a*).

On shot 7, 8, 9 the figure-forming pile warp thread is 22, pile warp thread 23 is provided for binding into the top weave, while in the previous pattern repeat the same pile warp thread 22 was figure-forming, and it is the turn of working pattern repeat A, for which lift plan (11) therefore must be used (see FIG. 3).

On shot 10, 11, 22 the figure-forming pile warp thread is provided for binding into the top weave, while the previous working pattern repeat was also figure-forming with pile thread of a different color which was provided for binding into the top weave, and now it is the turn of working pattern repeat B, for which lift plan (16) must therefore be used (see FIG. 3).

In the appended FIG. 4*a* the different positions of the different warp threads are shown in table form for each lift plan.

For the weave of FIG. 2*a* we need in succession the aprons 1, 14, 11 and 16. On leading off in the table of FIG. 4*a* we have, for example, for the figure-forming pile warp thread in succession the positions: bottom—top—bottom/top—bottom—top/bottom—top—bottom/top—bottom—top. This in fact corresponds to the positions of in succession pile warp thread (21) (for shot 1, 2, 3), pile warp/thread (22) (for shot 4, 5, 6 and shot 7, 8, 9) and pile warp thread (23) (for shot 10, 11, 12), as the schematic representation of the desired weave in FIG. 2*a* shows.

In FIG. 4*a* we can read off in the same way the positions of the other pile warp threads which correspond to the different lift plans. The other possible pile warp threads (see table of FIG. 4*a*) are: the previous figure-forming pile; the pile warp thread which is bound into the bottom weave (PBBW) if it is not the present or the previous figure-forming pile warp thread, the pile warp thread which is bound into the top weave (PBTW) if it is not the present or the previous figure-forming pile warp thread.

At the transition between two figure-forming pile warp threads which are provided for being bound into the same weave (TW or BW) if they are not figure-forming we notice that 2 pile sides of a different pile warp thread lie between two successive warp insertions of the same weave. Through the different color of the two pile warp threads a hazy appearance is given to the pile surface of the weave. These so-called double points occur in the weave, shown in FIG. 2*a*, between shot 10 and shot 11, at the transition from figure-forming pile warp thread (22) to figure-forming pile warp thread (23), both of which are bound into the top weave if they are not figure-forming. Two pile sides of different pile warp threads consequently lie between the wefts 10 and 11 in the top weave.

These double points occur (see table of FIG. 3) at the transition from a figure-forming pile warp thread provided for binding into the bottom weave (PFBW) to a figure-forming pile warp thread which is also provided for binding into the bottom weave (PFBW) and at the transition from a figure-forming pile warp thread provided for binding into the top weave (PFTW) to a figure-forming pile warp thread which is also provided for binding into the top weave (PFTW), both for weave pattern repeat A and for weave pattern repeat B of the base weave. Consequently, these double points occur with the use of lift plans 6, 15 and 16.

By acting on these aprons 5, 6, 15 and 16, we come to aprons 5', 6', 15' and 16' which replace the lift plans 5, 6, 15 and 16 respectively, and by means of which the double points at the pile side of the weave are avoided.

The aprons 5', 6', 15' and 16' are defined by means of FIG. 4*b*, which is a table relating to the positions of the different pile warp threads corresponding to each of these lift plans (5'), (6'), (15') and (16'). The use of this table is identical to the use of the table of FIG. 4*a*.

In the decision diagram for the selection of the aprons each of the lift plans numbers (5'), (6'), (15') and (16') can be filled in respectively next to the original numbers (5), (6), (15) and (16), while one has the choice in each case between (5) and (5'), (6) and (6'), (15) and (15'), (16) and (16'), depending on whether one wants the double points to occur along the pile side of the weave—aprons (5), (6), (15) and (16)—or whether one wishes to avoid this—lift plans (5'), (6'), (15') and (16').

An example of use of lift plan (16') instead of apron (16) is illustrated by means of FIG. 2*b*, where the same weave as that in FIG. 2*a* is shown schematically, while for the weave pattern repeat B of shot 10, 11, 12 lift plan (16') is used instead of lift plan (16). The figure-forming pile warp thread (23) keeps the same positions (top—bottom—top) in the case of lift plan (16') as in the case of lift plan (16). The previous figure-forming pile thread (22) is now, however, on shot (10) taken above the weft (WT10) instead of below it. The positions of the other bound-in pile warp threads (PBBW) and (PBTW)—which do not occur in the example—remain identical in the case of both lift plans (16) and (16').

No double point now occurs along the pile side in the top weave between the wefts WT10 and WT11 in FIGS. 2*a* and 2*b*, which was the case in FIG. 2*a*.

In FIG. 2*b* the double point now occurs along the rear side of the weave, above weft thread (WT10), where two different pile warp threads form a pile warp binding-in loop.

In the same way the use of aprons (5'), (6') and (15') can ensure that double points occur along the pile side of the weave, in those cases where according to FIG. 3 the use of lift plans (5), (6) and (15) was designated, both in the case of weave pattern repeat A and weave pattern repeat B of the base weave.

The advantage of this method according to the invention of making use of lift plans (5'), (6'), (15') and (16') lies in the fact that a hazy appearance is avoided on the pile surface of the weave.

The advantage of the method according to the invention in general is the fact that no mix contours occur now in the 20 face-to-face weaves produced, while the design fineness is not reduced, and the card designer does not have to carry out any additional time-consuming work, and in which the same weaving speed as before can be retained.

An arbitrary 6-shot pattern repeat with transition from PFBW to PFBW is recognized by 3 pile loops for every 6 shots, both in the bottom weave and in the top weave.

An arbitrary 6-shot pattern repeat with transition from PFBW to PFTW is recognized by 3 pile loops for every 6 shots, both in the bottom weave and in the top weave.

An arbitrary 6-shot pattern repeat with transition from PFTW to PFTW is recognized by 3 pile loops both in the bottom weave and in the top weave.

An arbitrary 6-shot pattern repeat with transition from PFTW to PFBW is recognized by 2 pile loops both in the bottom weave and in the top weave.

The number of color points in the card drawing of the carpet is equal to one third of the total number of shots, and each weft insertion of both the bottom weave and the top weave lying at the rear side of the tension warp is covered by 1 pile warp binding-off loop.

The figure drawing is thus perfectly visible on the back.

We claim:

1. A method of weaving face-to-face top and bottom pile weaves with figure-forming pile warps selectively bound in a top weave, bound in a bottom weave and extending between the top and bottom weaves respectively in bound-in portions and figure-forming pile portions, comprising currently weaving a top and a bottom weaves with a 2-shot weave according to a double weft weaving process, extending top binding warps and bottom binding warps and bound-in portions of figure-forming pile warps over two wefts while passing figure-forming pile portions of the pile warps over three wefts, and imposing working pattern repeats in groups of three double weft shots.

2. The method of claim 1, further comprising controlling each working pattern repeat for the figure-forming pile warps—over three double weft shots—by lift plans which determine positions of the figure-forming pile warps for each shot.

3. The method of claim 2, wherein the controlling further comprises controlling the figure-forming pile warps with eighteen different lift plans for the pile warps describing the position of each pile warp such that in a working pattern repeat over 3 wefts mixed color pattern contours are avoided.

4. The method of claim 3, wherein the controlling further comprises moving figure-forming pile warp portions between double weft shots, in which:

the figure-forming pile warp in an actual working pattern repeat is indicated by number 1;

the figure-forming pile warp from a previous pattern repeat is indicated by number 2;

the pile warp which is bound-in a bottom weave and is neither 1 nor 2 is indicated by number 3;

the pile warp which is bound-in a top weave and is neither 1 nor 2 is indicated by number 4; and in which bottom, middle and top portions for the pile warps indicate that the pile warps are respectively, below, between or above plural weft threads lying one above another, and in which the positions are abbreviated to B, M, T, such that in:

Lift Plan 1:
pile warp 1: B-T-B; pile warp 2: does not occur
pile warp 3: M-B-M; pile warp 4: T-M-T Lift Plan 2:
pile warp 1: T-B-T; pile warp 2: does not occur
pile warp 3: B-M-B; pile warp 4: M-T-M Lift Plan 3:
pile warp 1: B-T-B, pile warp 2: does not occur
pile warp 3: M-B-M; pile warp 4: T-M-T Lift Plan 4:
pile warp 1: T-B-T; pile warp 2: does not occur
pile warp 3: B-M-B; pile warp 4: M-T-M Lift Plan 5:
pile warp 1: B-T-B; pile warp 2: M-B-M
pile warp 3: M-B-M; pile warp 4: T-M-T Lift Plan 6:
pile warp 1: B-B-T; pile warp 2: T-M-B
pile warp 3: B-M-B; pile warp 4: M-T-M Lift Plan 7:
pile warp 1: B-T-B; pile warp 2: T-M-T
pile warp 3: M-B-M; pile warp 4: T-M-T Lift Plan 8:
pile warp 1: B-B-T; pile warp 2: T-T-M
pile warp 3: B-M-B; pile warp 4: M-T-M Lift Plan 9:
pile warp 1: B-T-B; pile warp 2: does not occur
pile warp 3: M-B-M; pile warp 4: T-M-T Lift Plan 10:
pile warp 1: T-B-T; pile warp 2: does not occur
pile warp 3: B-M-B; pile warp 4: M-T-M Lift Plan 11:
pile warp 1: B-T-B; pile warp 2: does not occur
pile warp 3: M-B-M; pile warp 4: T-M-T Lift Plan 12:
pile warp 1: T-B-T; pile warp 2: does not occur
pile warp 3: B-M-B; pile warp 4: M-T-M Lift Plan 13:
pile warp 1: T-T-B; pile warp 2: B-B-M
pile warp 3: M-B-M; pile warp 4: T-M-T Lift Plan 14:
pile warp 1: T-B-T; pile warp 2: B-M-B
pile warp 3: B-M-B; pile warp 4: M-T-M Lift Plan 15:
pile warp 1: T-T-B; pile warp 2: B-M-T
pile warp 3: M-B-M; pile warp 4: T-M-T Lift Plan 16:
pile warp 1: T-B-T; pile warp 2: M-T-M
pile warp 3: B-M-B; pile warp 4: M-T-M Lift Plan 17:
pile warp 1: does not occur; pile warp 2: does not occur
pile warp 3: M-B-M; pile warp 4: T-M-T Lift Plan 18:
pile warp 1: does not occur; pile warp 2: does not occur
pile warp 3: B-M-B; pile warp 4: M-T-M, the figure-forming pile warp in the working repeat is indicated by number 1;

the figure-forming pile warp from the previous repeat is indicated by number 2;

the pile warp which is bound into the bottom weave and is neither 1 nor 2 is indicated by number 3;

the pile warp which is bound into the top weave and is neither 1 nor 2 is indicated by number 4.

5. The method according to claim 4, further characterized in that:

if a pile warp which is provided for binding into a bottom weave occurs in the working repeat, while in the previous repeat no figure-forming pile warp occurs, lift plan 1 is used for a base weave repeat A and lift plan 2 is used for a base weave repeat B;

if a pile warp which is provided for binding into the bottom weave occurs in the working repeat, and in the previous repeat the same pile warp forms the pattern, lift plan 3 is used for a base weave repeat A and lift plan 4 is used for a base weave repeat B;

if a pile warp which is provided for binding into the bottom weave occurs in the working repeat, and in the previous repeat a different pile warp which is provided for being bound into the bottom weave forms the pattern, lift plan 5 is used for a base weave repeat A and lift plan 6 is used for a base weave repeat B;

if a pile warp which is provided for binding into the bottom weave occurs in the working repeat, and in the previous repeat a different pile warp which is provided for being worked into a top weave forms the figure, lift plan 7 is used for a base weave repeat A and lift plan 8 is used for a base weave repeat B;

if a pile warp which is provided for binding into the top weave occurs in the working repeat, while in the previous repeat no pattern-forming pile warp occurs, lift plan 9 is used for a base weave repeat A and lift plan 10 is used for a base weave repeat B;

if a pile warp which is provided for binding into the top weave occurs in the working repeat, while in the previous repeat the same pile forms the pattern, lift plan 11 is used for a base weave repeat A and lift plan 12 is used for a base weave repeat B;

if a pile warp which is provided for binding into the top weave occurs in the working repeat, while in the previous repeat a different pile warp which is provided for binding into the bottom weave forms the figure, lift plan 13 is used for a base weave repeat A and lift plan 14 is used for a base weave repeat B;

if a pile warp which is provided for binding into the top weave occurs in the working repeat, and in the previous repeat a different pile warp which is provided for binding into the top weave forms the pattern, lift plan 15 is used for a base weave repeat A and lift plan 16 is used for a base weave repeat B;

if no pattern-forming pile warp occurs in the working repeat, lift plan 17 is used for a base weave repeat A and lift plan 18 is used for a base weave repeat B.

6. The method of claim 4, characterized in that lift plans 5', 6', 15' and 16' are used in cases where lift plans 5, 6, 15, 16 respectively are provided, while the successive positions of each pile warp in a working repeat over 3 picks is determined by the lift plans 5', 6', 15' and 16', as follows:

Lift Plan 5':
pile warp 1: B-T-B; pile warp 2: B-B-M
pile warp 3: M-B-M; pile warp 4: T-M-T
Lift Plan 6':
pile warp 1: B-B-T; pile warp 2: T-B-B
pile warp 3: B-M-B; pile warp 4: M-T-M
Lift Plan 15':
pile warp 1: T-T-B; pile warp 2: B-T-T
pile warp 3: M-B-M; pile warp 4: T-M-T
Lift Plan 16':
pile warp 1: T-B-T; pile warp 2: T-T-M
pile warp 3: B-M-B; pile warp 4: M-T-M 7. Fabric with figure-forming piles made according to face-to-face pile weaving with plural pile warps selectively bound in a top weave, bound in a bottom weave and extending between the top weave and bottom weave respectively in a bound-in portion and a figure-forming pile portion, comprising the top and bottom weaves formed with a 2-shot weave according to a double weft weaving process, top binding warps and bottom binding warps and bound-in portions of pile warps being extended over two wefts while figure-forming pile portions of the pile warps are passed over three wefts, and working pattern repeats are imposed in groups of three double weft shots.

8. Fabric with figure-forming piles made according to face-to-face pile weaving of claim 7, further comprising each working pattern repeat for the pile-warps—being extended over three double weft shots—by weft lift plans which determine positions of the pile warps for each weft shot.

9. Fabric with figure-forming piles made according to face-to-face pile weaving of claim 8, wherein the pile warps have been controlled with eighteen different warp plans for the pile warps describing the position of each pile warp such that in a working pattern repeat over 3 wefts mixed color pattern contours are avoided.

10. Fabric with figure-forming piles made according to face-to-face pile weaving of claim 9, which;

a figure-forming pile warp in an actual working pattern repeat is indicated by number 1;
a figure-forming pile warp from a previous pattern repeat is indicated by number 2;
the pile warp which is bound-in a bottom weave and is neither 1 nor 2 is indicated by number 3;
the pile warp which is bound-in a top weave and is neither 1 nor 2 is indicated by number 4; and in which bottom, middle and top portions for the pile warps indicate that the pile warps are respectively, below, between or above plural weft threads lying one above another, and in which the positions are abbreviated to B, M, T, such that in:

Lift Plan 1:
pile warp 1: B-T-B; pile warp 2: does not occur
pile warp 3: M-B-M; pile warp 4: T-M-T
Lift Plan 2:
pile warp 1: T-B-T; pile warp 2: does not occur
pile warp 3: B-M-B; pile warp 4: M-T-M
Lift Plan 3:
pile warp 1: B-T-B, pile warp 2: does not occur
pile warp 3: M-B-M; pile warp 4: T-M-T
Lift Plan 4:
pile warp 1: T-B-T; pile warp 2: does not occur
pile warp 3: B-M-B; pile warp 4: M-T-M
Lift Plan 5:
pile warp 1: B-T-B; pile warp 2: M-B-M
pile warp 3: M-B-M; pile warp 4: T-M-T
Lift Plan 6:
pile warp 1: B-B-T; pile warp 2: T-M-B
pile warp 3: B-M-B; pile warp 4: M-T-M
Lift Plan 7:
pile warp 1: B-T-B; pile warp 2: T-M-T
pile warp 3: M-B-M; pile warp 4: T-M-T
Lift Plan 8:
pile warp 1: B-B-T; pile warp 2: T-T-M
pile warp 3: B-M-B; pile warp 4: M-T-M
Lift Plan 9:
pile warp 1: B-T-B; pile warp 2: does not occur
pile warp 3: M-B-M; pile warp 4: T-M-T
Lift Plan 10:
pile warp 1: T-B-T; pile warp 2: does not occur
pile warp 3: B-M-B; pile warp 4: M-T-M
Lift Plan 11:
pile warp 1: B-T-B; pile warp 2: does not occur
pile warp 3: M-B-M; pile warp 4: T-M-T
Lift Plan 12:
pile warp 1: T-B-T; pile warp 2: does not occur
pile warp 3: B-M-B; pile warp 4: M-T-M
Lift Plan 13:
pile warp 1: T-T-B; pile warp 2: B-B-M
pile warp 3: M-B-M; pile warp 4: T-M-T
Lift Plan 14:
pile warp 1: T-B-T; pile warp 2: B-M-B
pile warp 3: B-M-B; pile warp 4: M-T-M
Lift Plan 15:
pile warp 1: T-T-B; pile warp 2: B-M-T
pile warp 3: M-B-M; pile warp 4: T-M-T
Lift Plan 16:
pile warp 1: T-B-T; pile warp 2: M-T-M
pile warp 3: B-M-B; pile warp 4: M-T-M
Lift Plan 17:
pile warp 1: does not occur; pile warp 2: does not occur
pile warp 3: M-B-M; pile warp 4: T-M-T
Lift Plan 18:
pile warp 1: does not occur; pile warp 2: does not occur
pile warp 3: B-M-B; pile warp 4: M-T-M, the figure-forming pile warp in the working repeat is indicated by number 1;
the figure-forming pile warp from the previous repeat is indicated by number 2;
the pile warp which is bound into the bottom fabric and is neither 1 nor 2 is indicated by number 3;
the pile warp which is bound into the top fabric and is neither 1 nor 2 is indicated by number 4.

11. Fabric with figure-forming piles made according to face-to-face pile weaving of claim 9, characterized in that lift plans 5', 6', 15' and 16' are used in cases where lift plans 5, 6, 15, 16 respectively are provided, while the successive positions of each pile warp in a working repeat over 3 picks is determined by the lift plans 5', 6', 15' and 16', as follows:

Lift Plan 5':
pile warp 1: B-T-B; pile warp 2: B-B-M
pile warp 3: M-B-M; pile warp 4: T-M-T
Lift Plan 6':

pile warp 1: B-B-T; pile warp 2: T-B-B
pile warp 3: B-M-B; pile warp 4: M-T-M Lift Plan 15':
pile warp 1: T-T-B; pile warp 2: B-T-T
pile warp 3: M-B-M; pile warp 4: T-M-T Lift Plan 16':
pile warp 1: T-B-T; pile warp 2: T-T-M
pile warp 3: B-M-B; pile warp 4: M-T-M.

12. Fabric with figure-forming piles made according to face-to-face pile weaving of claim 10, wherein if a pile warp which is provided for binding into a bottom weave occurs in the working repeat, while in the previous repeat no figure-forming pile warp occurs, lift plan 1 is used for a base weave repeat A and lift plan 2 is used for a base weave repeat B;

if a pile warp which is provided for binding into the bottom weave occurs in the working repeat, and in the previous repeat the same pile warp forms the pattern, lift plan 3 is used for a base weave repeat A and lift plan 4 is used for a base weave repeat B;

if a pile warp which is provided for binding into the bottom weave occurs in the working repeat, and in the previous repeat a different pile warp which is provided for being bound into the bottom weave forms the pattern, lift plan 5 is used for a base weave repeat A and lift plan 6 is used for a base weave repeat B;

if a pile warp which is provided for binding into the bottom weave occurs in the working repeat, and in the previous repeat a different pile warp which is provided for being worked into a top weave forms the pattern, lift plan 7 is used for a base weave repeat A and lift plan 8 is used for a base weave repeat B;

if a pile warp which is provided for binding into the top weave occurs in the working repeat, while in the previous repeat no figure-forming pile warp occurs, lift plan 9 is used for a base weave repeat A and lift plan 10 is used for a base weave repeat B;

if a pile warp which is provided for binding into the top weave occurs in the working repeat, while in the previous repeat the same pile forms the pattern, lift plan 11 is used for a base weave repeat A and lift plan 12 is used for a base weave repeat if a pile warp which is provided for binding into the top weave occurs in the working repeat, while in the previous repeat a different pile warp which is provided for binding into the bottom weave forms the pattern, lift plan 13 is used for a base weave repeat A and lift plan 14 is used for a base weave repeat B;

if a pile warp which is provided for binding into the top weave occurs in the working repeat, and in the previous repeat a different pile warp Which is provided for binding into the top weave forms the pattern, lift plan 15 is used for a base weave repeat A and lift plan 16 is used for a base weave repeat B;

if no figure-forming pile warp occurs in the working repeat, lift plan 17 is used for a base weave repeat A and lift plan 18 is used for a base weave repeat B.

* * * * *